US005903206A

United States Patent [19]

Koga et al.

[11] Patent Number: 5,903,206

[45] Date of Patent: May 11, 1999

[54] TERMINAL FOR SOLENOID

[75] Inventors: Youjiro Koga, Kariya; Yasushi Miura, Toyoake; Kenji Hashimoto, Toyota, all of Japan

[73] Assignee: Aisin Seiki Kabushiki Kaisha, Aichi-pref., Japan

[21] Appl. No.: 08/546,218

[22] Filed: Oct. 20, 1995

[30] Foreign Application Priority Data

Oct. 27, 1994 [JP] Japan ..... 6-264278

[51] Int. Cl.[6] ..... H01F 27/29

[52] U.S. Cl. ..... 336/192

[58] Field of Search ..... 336/192

[56] References Cited

U.S. PATENT DOCUMENTS

| | | | |
|---|---|---|---|
| 3,663,914 | 5/1972 | Lane | 336/192 |
| 3,932,828 | 1/1976 | Plunkett et al. | 336/96 |
| 4,660,015 | 4/1987 | Finck et al. | 336/192 |
| 4,672,342 | 6/1987 | Bradt | 336/192 |
| 4,707,629 | 11/1987 | Best | 310/71 |
| 4,719,440 | 1/1988 | Nakamura et al. | 336/192 |
| 4,728,916 | 3/1988 | Fontecchio et al. | 335/255 |
| 4,804,340 | 2/1989 | Hamer et al. | 439/709 |
| 5,264,816 | 11/1993 | Degenhart et al. | 336/192 |
| 5,307,038 | 4/1994 | Ishimaru | 335/296 |
| 5,510,762 | 4/1996 | Carey et al. | 336/192 |

*Primary Examiner*—Michael L. Gellner
*Assistant Examiner*—Anh Mai
*Attorney, Agent, or Firm*—Hazel & Thomas, PC

[57] ABSTRACT

A terminal for a solenoid has a weld portion to which an end portion of a lead wire of the solenoid covered with a cover member is welded. The terminal also has a clamp portion for clamping a portion of the lead wire that is located toward a main body of the solenoid from the end portion of the lead wire. Tensile loads on the lead wire of the solenoid are received by the clamped portion of the lead wire and the welded end portion of the lead wire remains free from tensile loads.

3 Claims, 3 Drawing Sheets

TERMINAL FOR SOLENOID

BACKGROUND OF THE INVENTION

1. Field of the Invention

The present invention relates to a terminal for a solenoid which is used, for example, on solenoid-operated valves or sensors 2. Description of the Prior Art In a conventional solenoid valve (electromagnetic valve) as shown in FIGS. 3 and 4, a solenoid 101 of solenoid valve 20 is covered with a resin molding 201. Solenoid valve 200 has a connector 202 for supplying power to the solenoid 101. Lead wires of solenoid 101 are connected to connector pins.

Solenoid 101 is formed by winding a wire on a resin bobbin 102, as illustrated in FIG. 4. The two end portions of solenoid 101 form lead wires 103, 104. Lead wires 103, 104 are connected by welding (fusing) to weld portions 107, 108 of terminals, that is, base portions of connector pins 105, 106.

When lead wires 103, 104 are welded to weld portions 107, 108, crystals in portions of lead wires 103, 104 adjacent to weld portions 107, 108 become large and rough. Such roughly grown crystals adversely affect the mechanical strength of lead wires 103, 104.

Solenoid valves are used in, for example, various control mechanisms in automotive engines. As an engine is repeated operated and stopped, the hot-cold cycles repeated expand and shrink resin mold 201 of solenoid valve 200, moving solenoid 101 back and forth. Because of such expansion and shrinkage, the portions adjacent to weld portions 107, 108 at which lead wires 103, 104 of solenoid 101 are fixed, receive tensile loads. Although the portions of lead wires 103, 104 adjacent to weld portions 107, 108 have roughly grown crystals that adversely affect the mechanical strength thereof as described above, conventional solenoid valves are designed so that no significant problems occur under normal working conditions.

However, there is a growing demand for increased service life of various component parts of motor vehicles or other machines that include solenoid valves and various sensors.

SUMMARY OF THE INVENTION

Accordingly, it is an object of the present invention to provide a terminal for a solenoid that has great strength against tensile loads.

According to the present invention, there is provided a terminal for a solenoid comprising a weld portion to which a lead wire of a solenoid covered with a cover member is welded, and a clamp portion for clamping a portion of the lead wire that is more remote from the end of the lead wire than a portion of the lead wire that is welded to the weld portion from the end thereof.

Since the lead wire of a solenoid is welded to the weld portion of the terminal and clamped by the clamp portion of the terminal at the portion of the lead wire that is located at a side of the main body of the solenoid from the welded portion, the lead wire is firmly fixed to the terminal.

Other objects and features of the present invention will be apparent from the following detailed description of the preferred embodiment.

BRIEF DESCRIPTION OF THE DRAWINGS

The invention will be further described in conjunction with the accompanying drawings, in which.

The invention will now be described in conjunction with the accompanying drawings, wherein like reference numerals represent like parts.

DETAILED DESCRIPTION OF THE PREFERRED EMBODIMENT

Figure 1:
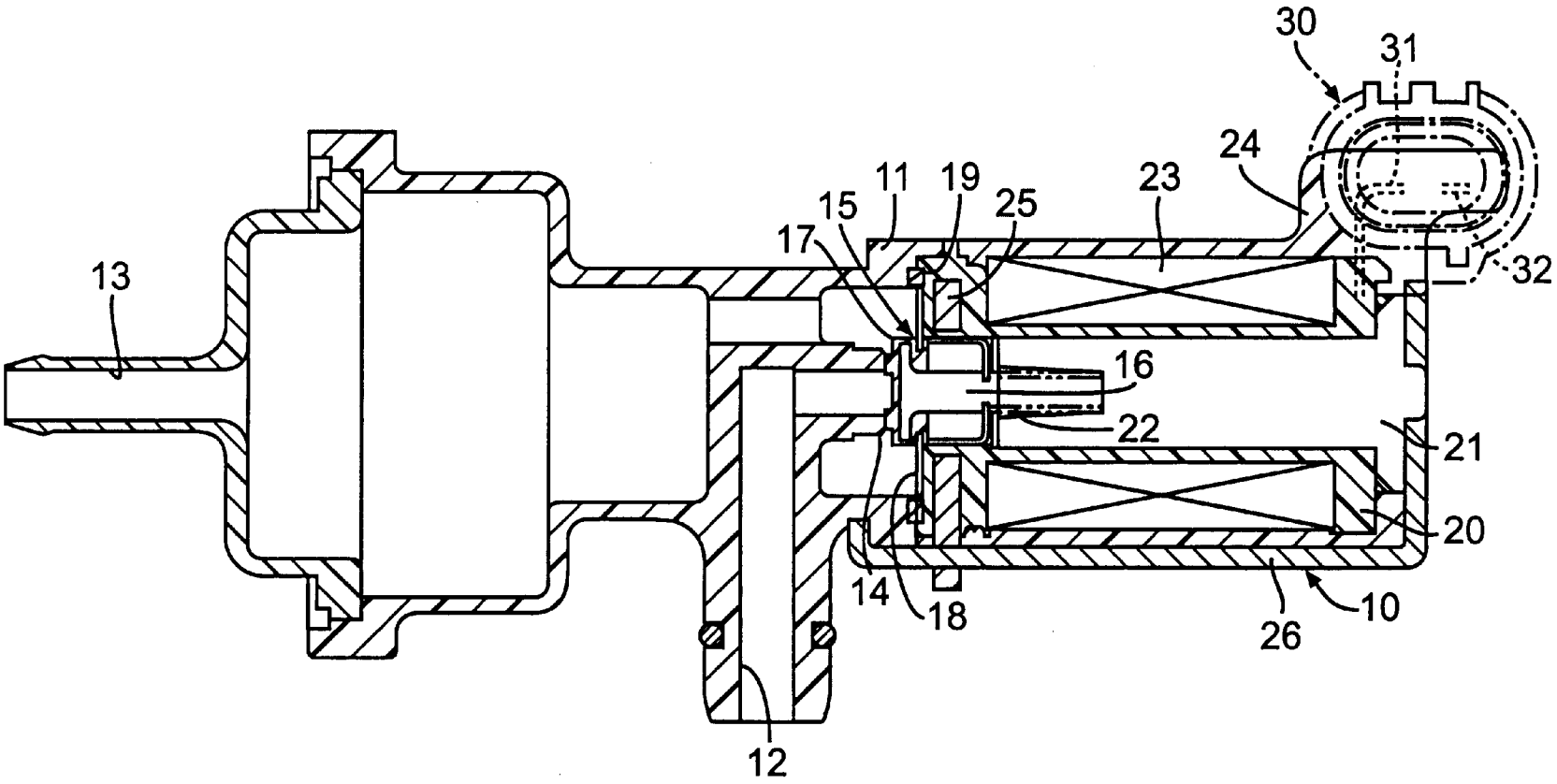
FIG. 1 is sectional view of a solenoid valve according to a preferred embodiment of the invention.

Referring to FIG. 1, a solenoid valve 10 comprising a housing 11 having ports 12, 13, a valve seat 14, and a valve member 15, that is operable against the valve seat 14 so as to control a fluid communication between ports 12 and 13. Valve member 15 is essentially composed of a movable core 16 and a seal member 17. Valve member 15 is supported on housing 11 through a diaphragm 18 so as to be movable back and forth in an axial direction. Diaphragm 18 is firmly connected at its inner periphery to seal member 17, and at its outer periphery to housing 11 and a bobbin 20 through another seal member 19.

Facing movable core 16, a stationary core 21 is provided in an inside space of a bobbin 20. A spring 22 is disposed between cores 16 and 21 so as to urge valve member 15 toward valve seat 14. A solenoid 23 is formed by winding a wire coated with a coating, for example, enamel on bobbin 20. The wound portion corresponds to a main body of solenoid 23. Solenoid 23, including lead wires 33, 34, is covered with a resin molding (cover member) 24. A yoke 25 and a side yoke 26 form a magnetic circuit together with valve member 15 and stationary core 21. Solenoid 23 is electrically connected to connector pins 31, 32 of a connector portion 30, thereby receiving power from a power supply (not shown).

Figure 2:
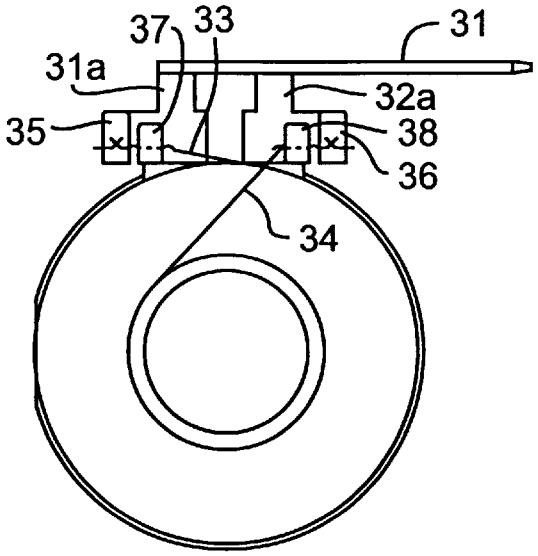
FIG. 2 is an enlarged front view of main portions of the solenoid valve shown in FIG. 1.
Figure 3:
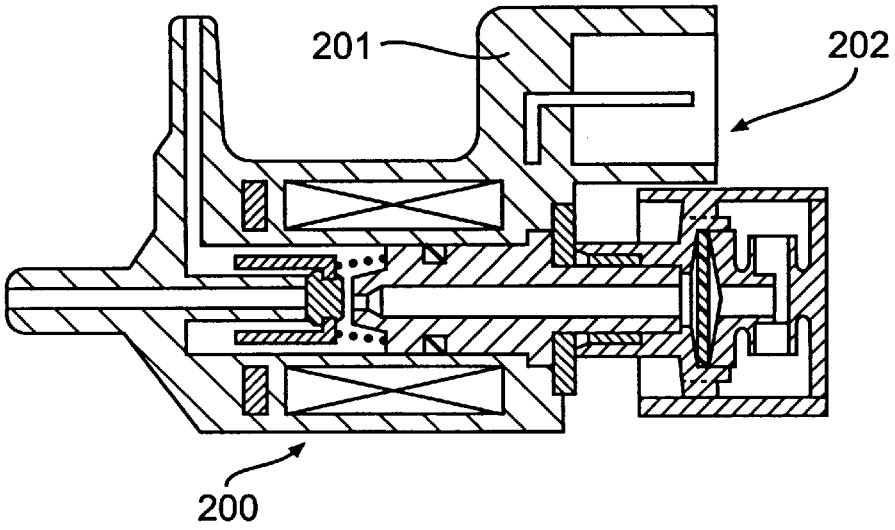
FIG. 3 PRIOR ART
FIG. 3 is a sectional view of a conventional solenoid valve.
Figure 4:
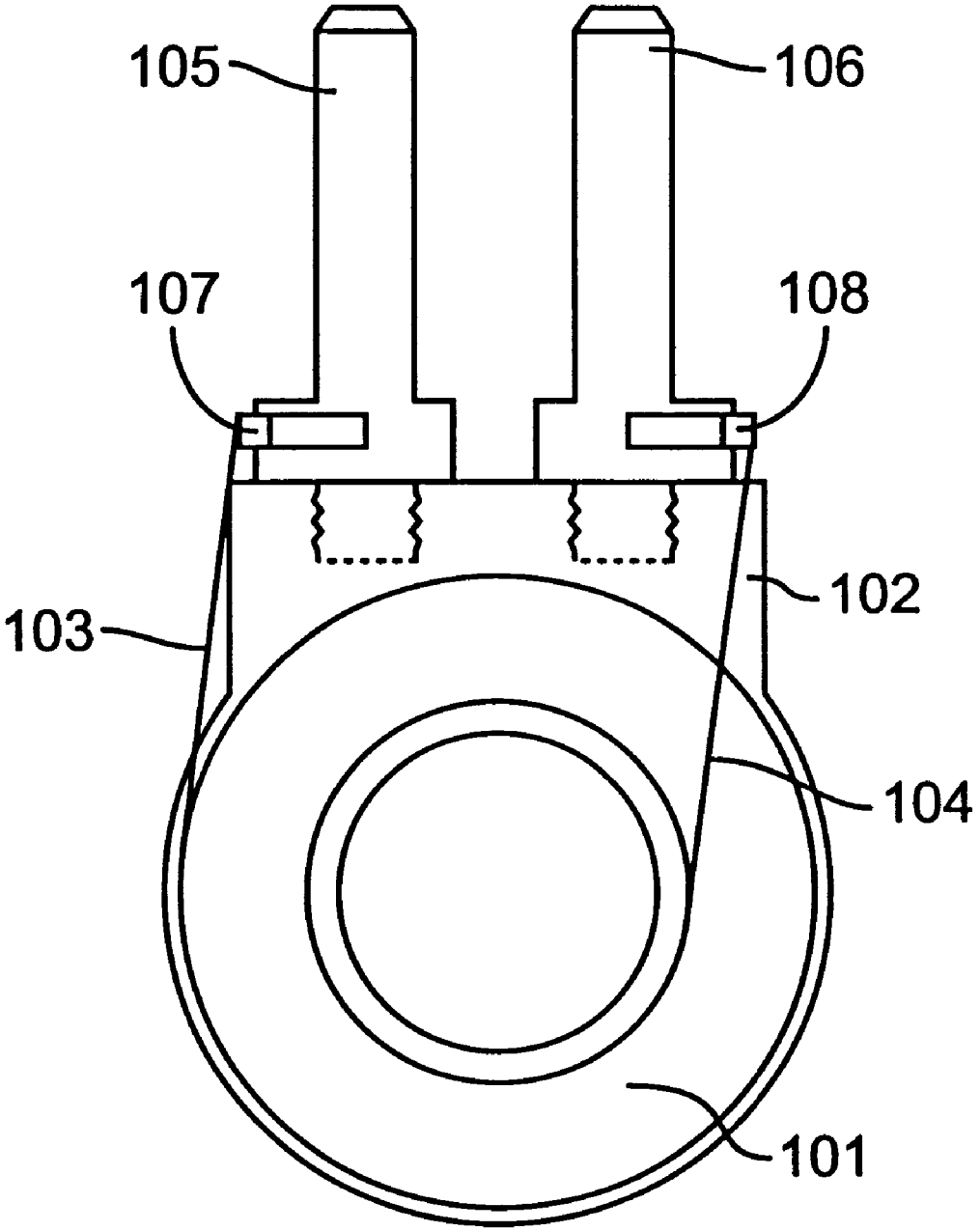
FIG. 4 PRIOR ART
FIG. 4 is an enlarged front view of main portions of the conventional solenoid valve shown in FIG. 3.

This electric connecting structure will be described with reference to FIG. 2. Terminals 31*a*, 32*a* covered with resin molding 24, together with solenoid 23, are electrically connected to connector pins 31, 32, respectively. The lead wires 33, 34 are respectively provided at respective ends of solenoid 23, extending generally in tangential directions with respect to a circumferential surface of solenoid 23. The coating has been removed from end portions of the lead wires 33, 34. The exposed end portions of the lead wires 33, 34 are welded (fused) to weld portions 35, 36 of terminals 31*a*, 32*a* by, for example, resistance welding. Solenoid 23 is thereby electrically connected connector pins 31, 32. The welding process roughly grows crystals of materials of lead wires 33, 34 in portions of the lead wires 33, 34 adjacent the ends thereof.

Terminals 31*a*, 32*a* have clamp portions 37, 38 protruding toward the top of the sheet of the drawing. Each lead wire 33 (34) (the following description will be made in conjunction with one of the lead wires for convenience) is clamped by clamp portion 37 (38) at a portion of lead wire 33 (34) that is located toward bobbin 20 from the end portion welded to weld portion 35 (36). According to this embodiment, a portion of clamp portion 37 (38) is bent to pinch and clamp that portion of the lead wire 33 (34). The portion of lead wire 33 (34) clamped by clamp portion 37 (38) is coated with the coating.

The repeated temperature changes (hot-cold cycles) that the solenoid valve undergoes expand and shrink resin molding 24, moving the solenoid 23. lead wires 33, 34 accordingly receive tensile loads. However, the tensile loads are applied to portions of lead wires 33, 34 adjacent to clamp portions 37, 38 that serve as fixing points and that are coated with the coating and retain unaffected strength, but not applied to portions of lead wires 33, 34 adjacent to weld portions 35, 36 that are not coated with the coating and that have roughly grown crystals.

According to the present invention, when the lead wires receive tensile loads, the loads are applied to clamped portions of the lead wires that are located toward bobbin 20 from the ends thereof, but not applied to welded end portion that have roughly grown crystals. That is, the clamped portions of the lead wires, which retain unaffected mechanical strength, receive tensile loads, thus improving the connection strength between the lead wires and the terminals. Therefore, it is possible to extend the service of various component parts, including solenoids.

While the present invention has been described in connection with one of its preferred embodiments, it should be understood that the invention is not limited to the disclosed embodiments. To the contrary, the invention is intended to cover various modifications and equivalent arrangements included within the spirit and scope of the appended claims.

What is claimed is:

1. A terminal for a solenoid having a bobbin and a lead wire wound on the bobbin and covered with a cover member, comprising:

a weld portion to which first and second end portions of the lead wire are welded; and a clamp portion for rigidly clamping first and second clamp portions of said lead wire, said first and second clamp portions being formed closer to the bobbin along said lead wire relative to said first and second end portions of said lead wire, whereby said first and second clamp portion are positionally clamped by said clamp portion closer to the bobbin than said first and second end portions are welded to said weld portion.

2. A terminal for a solenoid according to claim 1, wherein said first and second clamp portions of said lead wire rigidly clamped by said clamp portion are coated, and said first and second end portions of said lead wire fixed to said weld portion are uncoated.

3. A terminal for a solenoid according to claim 2, wherein said clamp portion is bent to clamp therein said first and second clamp portions of said lead wire that located toward said bobbin of said solenoid relative to said first and second end portions of said lead wire.

* * * * *